United States Patent [19]

Patel et al.

[11] 4,208,556

[45] Jun. 17, 1980

[54] FORCE CONVECTION HEAT PUMP AND TEMPERATURE MEASURING SYSTEM FOR A GAS INSULATED TWO PRESSURE BREAKER

[75] Inventors: Amrut R. Patel, Brandon; Donald M. Hansen, Jackson, both of Miss.

[73] Assignee: Siemens-Allis, Inc., Atlanta, Ga.

[21] Appl. No.: 826,873

[22] Filed: Aug. 22, 1977

[51] Int. Cl.[2] ..... H01H 33/54

[52] U.S. Cl. ..... 200/148 E; 700/148 B

[58] Field of Search ..... 200/148 E, 148 R, 148 B

[56] References Cited

U.S. PATENT DOCUMENTS

| | | | |
|---|---|---|---|
| 3,703,619 | 11/1972 | Henry | 200/148 E |
| 3,721,798 | 3/1973 | Beierer | 200/148 E |
| 3,749,869 | 7/1973 | Imataki | 200/148 E |
| 3,935,408 | 1/1976 | Taylor | 200/148 E |
| 4,006,332 | 1/1977 | Crookston et al. | 200/148 E |

*Primary Examiner*—Robert S. Macon

*Attorney, Agent, or Firm*—Frederick W. Powers, III

[57] ABSTRACT

A heating system within a high pressure gas enclosure which includes a heat emission block surrounded by an insulating tube to form a forced flow convection pump; temperature probes within the high pressure gas enclosure are located so that they will not be influenced by the operation of the heaters.

6 Claims, 3 Drawing Figures

FORCE CONVECTION HEAT PUMP AND TEMPERATURE MEASURING SYSTEM FOR A GAS INSULATED TWO PRESSURE BREAKER

BACKGROUND OF THE INVENTION

With the demand for reduced size substation the gas-insulated substation components, such as circuit breakers, has been developed and in this type of component, the insulating gas requires attention as to its temperature especially in the two-pressure type of circuit breaker. In this type of arrangement, gas in a high pressure chamber discharges into a low pressure chamber in which the separable circuit interrupting contacts are housed. In such apparatus, the insulating gas in the high pressure chamber must be maintained above a predetermined temperature to prevent the insulating gas from liquefying in which state it loses its dielectric properties. To overcome this undesirable condition, various heating arrangements have been proposed.

In U.S. Pat. No. 2,955,182, a heater unit of the resistance type is indicated as being secured to the outside of the high pressure tank. In U.S. Pat. No. 3,118,995, a nonmagnetic strip is utilized to force magnetic flux to pass through the wall of the high pressure tank to set up eddy current loses within the tank wall and thereby heat the insulating gas. In U.S. Pat. No. 3,137,777, the heat of the compressor is utilized to heat the gas entering the low pressure side of the compressor. In U.S. Pat. No. 3,303,310, a resistance coil heater is shown wound around the insulated high pressure tank. In U.S. Pat. No. 3,358,104, there is disclosed an arrangement in which a current transformer is inductively coupled to one of the terminal bushings of the circuit breaker and utilized to provide current for a heating element in the high pressure tank. U.S. Pat. No. 3,359,390 discloses a filament winding heating arrangement in series with the compressor to heat the insulating gas. U.S. Pat. No. 3,566,062 indicates the desirability of using resistance heaters with the main gas reservoir. U.S. Pat. No. 3,846,601 discloses a method of heating the insulating gas by current flow through a hollow terminal stud which communicates with a high pressure gas tank. U.S. Pat. No. 3,903,388 utilizes a heater blanket around the high pressure gas tank to maintain the gas in its gaseous state.

All of the aforementioned U.S. patents indicate the on-going search for a more efficient and accurate means for heating insulating gas with accurate heating sensing. It is also apparent that the prior art, as exemplified by the aforementioned patents, have taken the approach of heating the tank or the tank line with temperature controls located very close to the heaters. This, it is believed, is not an efficient way of heating and, with temperature controls close to the heaters, they tend to shut the heaters off before the gas reaches a correct temperature.

SUMMARY OF THE INVENTION

The invention herein disclosed includes a heat emission block having radial fins which is surrounded by an insulating tube which forms a forced flow convection heat pump. Temperature probes are located in positions wherein they are not effected by the heaters. The entire arrangement is located within the high pressure zone. The heat emission block will release heat through the associated fins to the surrounding cold insulating gas. The insulating tube acts as a chimney and will force substantially all of the hot gas to rise up in the middle of the high pressure zone. The cold gas will come down from the sides and will enter the heater block from the bottom of the insulating chimney. The temperature sensor is located in the cold zone and is not effected by the heater.

It is an object of the present invention to provide an insulating gas heating system which acts directly on the cold gas.

Still another object of the present invention is to provide an insulating gas heater arrangement that is located within the high pressure zone.

Yet another object of the present invention is to provide an insulating gas heater arrangement that forms a forced flow convection pump.

Other objects and advantages of the present invention will become more readily apparent from the detailed description of the invention.

DESCRIPTION OF THE INVENTION

Figure 1:
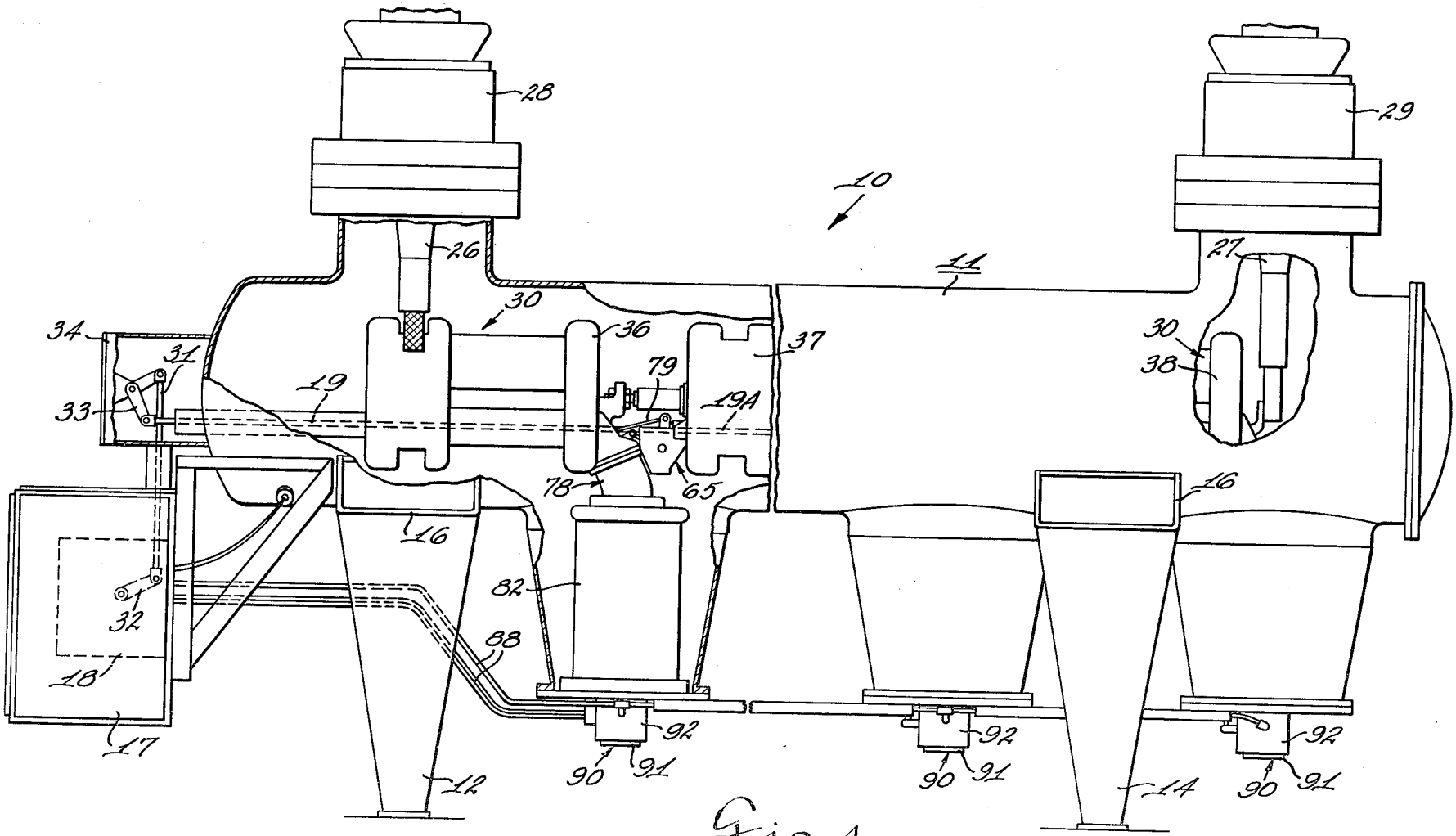
FIG. 1 is a fragmentary view in side-elevation with parts broken away to show serially connected interrupters of a gas-insulated circuit breaker in which the present invention is incorporated.

Referring now to the drawings and more particularly to FIG. 1, the reference number 10 generally designates a single phase gas-insulated circuit breaker. Generally, the circuit breaker 10 includes a grounded tank or enclosure 11 which is adapted to be gas tight. The enclosure 11 is mounted on supports 12 and 14 which are welded or otherwise secured to transversely extending steel side beams 16. Adjacent the left end of the enclosure 11 is an operating mechanism housing 17 in which, among other equipment, is an operating mechanism 18 of a suitable type. The operating mechanism 18 is operable upon a signal to effect longitudinal movement of an interconnected pull-rod 19 in an interrupter closing operation. As shown, the pull-rod 19 is disposed within the enclosure 11 and extends parallel to the longitudinal axis of the enclosure. Terminal bushings 26 and 27 extend downwardly into the interior of the enclosure 11 through cylindrical supports 28 and 29, respectively.

The interior ends of the terminal bushings 26 and 27 are electrically connected to each end of arc extinguishing assemblage 30 but do not support the assemblage 30.

The operating mechanism 18 within the housing 17 is operatively connected to the pull-rod 19 by means of a vertical rod 31, the lower end of which is pivotally connected to an operating lever 32 of the mechanism 18. The upper or opposite end of the vertical rod 31 extends into an end box 34 and is pivotally connected to one end of pivotal bell crank 33. The other end of the bell crank 33 is pivotally connected to the end of the pull-rod 19. The pull-rod 19 has a connection with the several axially aligned pull-rods 19A, associated with the interrupters 37 and 38, respectively, and are arranged to effect the simultaneous movement of the contacts of the plurality of interrupters 36, 37 and 38 in an opening and closing movement. The separation between the several movable contacts associated with the interrupter and the associated relatively stationary contacts draws a plurality of serially related arcs in an arcing area.

Each of the interrupter units 36, 37 and 38 are substantially similar and a description of the interrupter unit 36 will also apply to the other units. The interrupter unit 36 includes a relatively stationary contact structure (not shown) that is cooperable with a relatively movable tubular contact structure (not shown).

The movable contact is actuated between an open and a closed position by linkage means 65, operatively connected to the substantially centrally disposed, longitudinally extending pull-rod 19.

Extinction of the arcs drawn between the contacts of the interrupter 36 in the arcing area at the axial end of the movable contacts is aided by means of a blast of high pressure gas to the arcing area. The blast of high pressure gas is released by operation of a blast valve 78. The opening operation of the blast valve is synchronized with the opening of the contacts and is accomplished by the associated linkage 79. The linkage 79 is connected to the contact linkage 65 and operates in unison therewith upon movement of the pull-rod 19 in its second direction to open the contacts. As the contacts part, the blast valve is opened so that a blast of gas at a relatively high pressure is directed to the arcing area to effect extinction of the arc drawn between the movable contacts. For a more detailed description of the blast valve, contacts and operating linkage reference maybe had to U.S. Pat. No. 3,852,548.

Associated with the interrupter 36 is a high pressure gas storage tank or chamber 82. The storage tank contains a volume of gas for its associated interrupter.

As previously mentioned the gas system for the circuit interrupter 10 shown is a two-pressure closed cycle arrangement utilizing an efficient dielectric insulating gas such as sulfur hexafluoride ($SF_6$) gas. The high pressure gas is provided for the purpose of effecting arc extinction between the separating contacts of the circuit breaker. On the other hand, the low pressure gas provides the required dielectric insulation between the live or energized components within the grounded enclosure 11. In the arrangement disclosed, the gas at a high pressure is contained within the storage tank 82, constructed of nonconducting material such as fiberglass, located within the enclosure 11.

The low pressure system includes the enclosure 11 and piping 88 connecting a compressor (not shown) within the cabinet 17 which is operable to establish the pressure difference between the high and low pressure systems.

Figure 3:
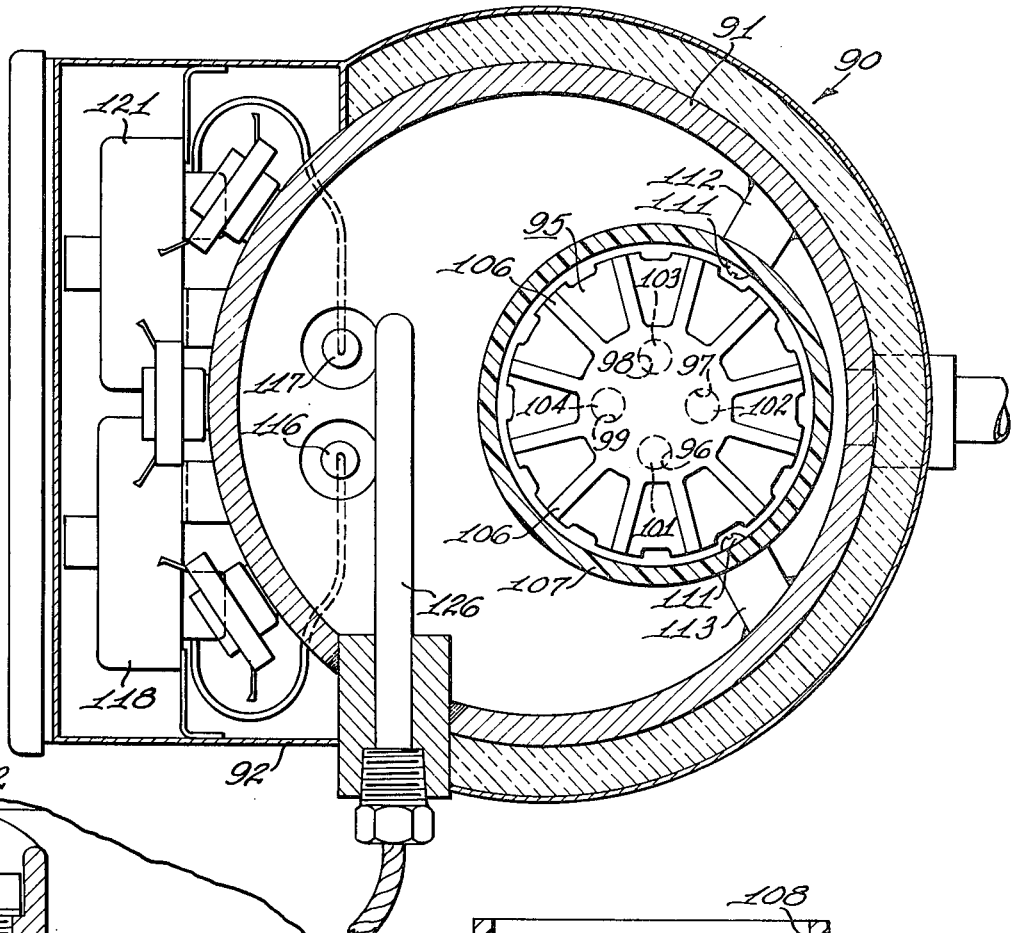
FIG. 3 is a view in vertical section taken in a plane represented by the line III—III in FIG. 2.
Figure 2:
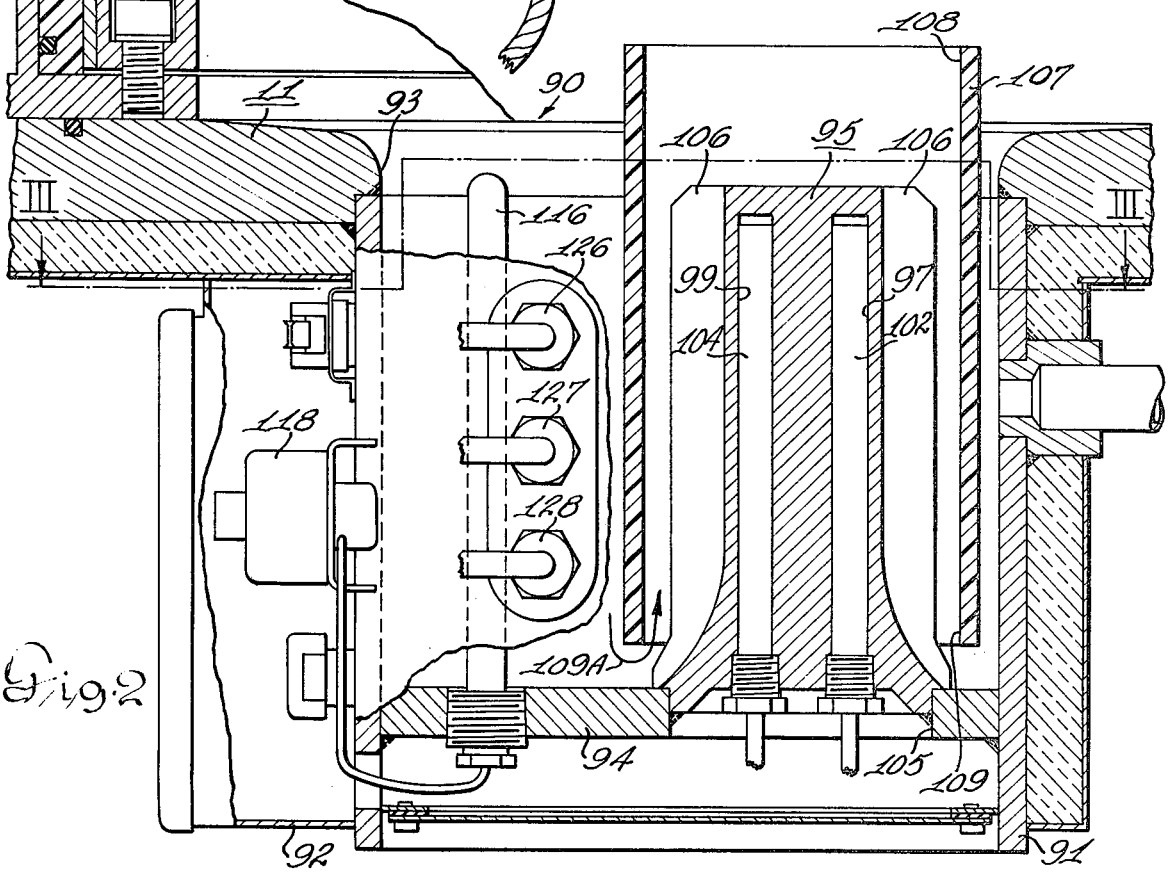
FIG. 2 is an enlarged detailed view partly in vertical section and partly in elevation of the heater arrangement within the high pressure zone of an interrupter.

The high pressure storage tank 82 is provided with heater means 90 to prevent liquefication of the high pressure gas with the resulting drop in pressure. In accordance with the preferred arrangement of the present invention, the heating means 90 is located within a chamber 91 that communicates with the interior of the high pressure storage tank 82. An insulating shroud 92 surrounds the extending portion of the heater to afford it protection from excessive heat loss and provide a protected area to make electrical connections. As best shown in FIGS. 2 and 3, the chamber 91 is an elongated cylindrical structure welded into a suitable formed opening 93 in the enclosure 11. Recessed within the chamber 91 is a circular plate 94 that serves as a mounting plate for an upwardly extending heater block 95. Formed in the heater block 95 are a plurality of vertically extending elongated blind bores 96, 97, 98 and 99 which are spaced 90° relative to each other about the axis of the block 95. Within each bore 96-99 there is a heater element 101, 102, 103 and 104 respectively. The heaters 101, 102, 103 and 104 are removably inserted into the respective bores from the bottom of the heater block 95 through an access opening 105 provided in the mounting plate 94. The mounting plate 94 is sealed in gas tight relationship to the interior surface of the cylindrical chamber 91. In turn, the heater block 95 is sealed in gas tight relationship in the access opening 105. Thus, the gas tight integrity of the enclosure 11 is not compromised. Thus, with the heaters 101, 102, 103 and 104 operating, the heat is conducted by the heater block 95 to the surrounding atmosphere, which in the present application is the insulating $SF_6$ gas, at a relatively high pressure.

To increase the ability of the heating block 95 to heat the surrounding atmosphere, the block 95 is formed with a plurality of vertical radially extending fins 106. The fins 106 increase the radiation area of the heater block 95 to provide for a more rapid heating of the insulating gas.

To provide for a more effective heating of the high pressure insulating gas and to alleviate localized heating, there is provided an insulated tube or chimney 107. By providing the chimney 107, a force flow convection pump is formed. In this respect as the heat emission block 95 gives off heat to the surrounding gas atmosphere, the heated gas tends to rise moving out through the top opening 108 of the chimney. As the heated gas moves out, it is replaced by the relatively cold gas that flows on the outside of the chimney and enters the chimney via the lower or bottom opening 109 as indicated by the arrow 109A. Thus the insulating gas in the high pressure reservoir 82 is constantly circulating within the chamber as it is being heated. This insures that the high pressure gas is evenly heated and no cold spots will exist.

The chimney 107 is of an insulating material, such as fiberglass, with its axis parallel to but offset with respect to the axis of the cylindrical chamber 91. For mounting the chimney in operative position the cylindrical tube 91 is provided with two radial inwardly extending rib members 112 and 113. Screws 111 extend through the chimney and threadedly engage in suitable openings formed in the rib members to maintain the chimney 107 in position.

To prevent liquefication of the $SF_6$ insulating gas at 250 psig, it is important to maintain the gas at substantially 65° F. It has been found that a more efficient heating operation can be performed if temperature sensing is accomplished within the area in which the high pressure gas is contained and yet not affected by the heater itself. In other words, sensing the temperature of the gas itself is the important criterion. To this purpose a pair of temperature sensing probes 116 and 117 are mounted in vertical position. The temperature sensing probes are inserted through suitable threaded openings formed in the plate 94 and are located outside of the chimney 107. Thus, the probes 116 and 117 are operable to sense the temperature of the high pressure gas circulating within the reservoir 82. In the preferred arrangement, the temperature sensor 116 is connected to a remote sensor thermostat 118. The thermostat 118 operates to control the on-off condition of the heating rods 101 and 103. The thermostat 118 is set at 75° F. Thus, when the temperature of the gas in the reservoir 82 drops below 75° F. the thermostat 118 turns the heaters 101 and 103 on. In a similar manner the heaters 102 and 104 are controlled by a remote sensor thermostat 121 which is set at 65° F. Thus, if the temperature of the high pressure gas in the reservoir 82 drops below 65° F., the thermostat operates to turn the heater rods 102 and 104 on. Below 65° F. all of the heater rods 101, 102, 103 and 104 will be on to bring the temperature of the gas up quickly. After the temperature of the gas reaches 65° F. the heater rods 102 and 104 will be turned off and the gas heated to 75° F. by the heater rods 101 and 103.

In the arrangement shown, there is also provided another temperature sensor 126 and a pair of density probes 127 and 128. These units are inserted into high pressure gas atmosphere in a vertical plane in stacked spaced-apart relationship through the wall of the tubular chamber 91. The temperature probe 126 serves three functions in that it activates a high temperature alarm when the temperature of the high pressure gas elevates to 160° F.; it also operates to activate an alarm when the temperature of the high pressure gas falls to 50° F.; and, finally it will also operate to lockout the compressor (not shown) when the temperature of the high pressure gas elevates to 180° F.

Density probe 127 operates to turn on the compressor (not shown) after the breaker 36 operates. This is for the purpose of recharging the high pressure reservoir 82 and relieving the gas in the low pressure enclosure 11. Density probe 128 provides for the lockout of the circuit breaker after four consecutive breaker operations and when the pressure in the reservoir 82 is down to 220 psig. With this condition the compressor will be turned on to return the pressure in the reservoir to 250 psig.

The embodiments of the invention in which an exclusive property or privilege is claimed are defined as follows:

1. In a two-pressure gas circuit interrupter having a low pressure enclosure and a high pressure enclosure including a bottom surface, and provided with a compressor to supply gas under high pressure to the high pressure enclosure, a heater block fully within and extending upwardly from the bottom surface of the high pressure enclosure;

at least one heater element extending within said heater block;

a tubular chimney disposed about said heater block and spaced therefrom to define a generally vertical space about said heater block, said tubular chimney and heater block cooperating to produce an updraft of heated gas within said tubular chimney and a downdraft of unheated gas outside tubular chimney; and temperature sensor means disposed within high pressure enclosure and outside said tubular chimney for sensing the temperature of the unheated gas, said temperature sensor means being isolated from the influence of said heater block.

2. The invention defined in claim 1, further including a plurality of vertically-extending heat radiating fins arising from the surface of said heater block.

3. The invention as defined in claim 2, wherein said vertically-extending fins extend radially outwardly from said heater block.

4. The invention as defined in claim 3, wherein said chimney terminates in a lower end thereof, said lower end being spaced above said bottom surface of said high pressure enclosure.

5. Apparatus according to claim 1 wherein said heater block is provided with a plurality of longitudinally extending blind bores; and, a heating rod removably disposed within each of said blind bores.

6. Apparatus according to claim 5 wherein said heating rods are associated together in pairs;

said temperature sensor includes a first temperature sensor probe located within the high pressure enclosure and operably connected to effect activation of a first pair of heater rods when the temperature of the gas in the high pressure enclosure reaches a first predetermined value;

a second temperature sensor probe located within said high pressure enclosure and operably connected to effect activation of a second pair of heater rods when the temperature of the gas in the high pressure enclosure reaches a second predetermined value.

* * * * *